US005700294A

United States Patent [19]

Boittiaux et al.

[11] Patent Number: 5,700,294

[45] Date of Patent: Dec. 23, 1997

[54] METHOD OF WASHING WITH DETERGENT COMPOSITIONS COMPRISING AMORPHOUS SILICOALUMINATE SCAVENGERS OF CALCIUM PRECIPITATES

[75] Inventors: Patrick Boittiaux, Saint Mande; Virginie Couvret, Paris; Daniel Joubert, Vineuil Saint Firmin, all of France

[73] Assignee: Rhone-Poulenc Chimie, Courbevoie Cedex, France

[21] Appl. No.: 584,244

[22] Filed: Jan. 11, 1996

Related U.S. Application Data

[63] Continuation of Ser. No. 405,932, Mar. 17, 1995, abandoned, which is a continuation of Ser. No. 67,011, May 26, 1993, abandoned.

[30] Foreign Application Priority Data

May 26, 1992 [FR] France ..... 92 06419

[51] Int. Cl.[6] ..... B08B 3/08; C11D 7/20; C11D 7/60; D06F 35/00

[52] U.S. Cl. ..... 8/137; 134/25.2; 510/442; 510/507; 510/509; 510/511

[58] Field of Search ..... 8/137; 510/532, 510/507, 509, 511, 315, 323, 335, 442; 134/25.2

[56] References Cited

U.S. PATENT DOCUMENTS

| | | | |
|---|---|---|---|
| 2,909,490 | 10/1959 | Metziger | 252/135 |
| 3,821,119 | 6/1974 | Temple | 252/135 |
| 3,886,079 | 5/1975 | Burke | 252/109 |
| 4,022,704 | 5/1977 | Balfanz et al. | 252/135 |
| 4,049,586 | 9/1977 | Collier | 252/532 |
| 4,083,795 | 4/1978 | Joubert | 252/99 |
| 4,096,081 | 6/1978 | Phenicie et al. | 252/89.1 |
| 4,126,574 | 11/1978 | Reinwald et al. | 252/179 |
| 4,169,806 | 10/1979 | Davis et al. | 252/99 |
| 4,180,485 | 12/1979 | Llenado | 252/532 |
| 4,207,197 | 6/1980 | Davis et al. | 252/99 |
| 4,213,874 | 7/1980 | Williams et al. | 252/174.25 |
| 4,243,544 | 1/1981 | Taylor | 252/135 |
| 4,276,326 | 6/1981 | Joshi | 252/91 |
| 4,288,342 | 9/1981 | Wagner, III et al. | 252/140 |
| 4,303,556 | 12/1981 | Llenado | 252/527 |
| 4,310,431 | 1/1982 | Joshi | 252/91 |
| 4,407,722 | 10/1983 | Davies et al. | 252/91 |
| 4,414,129 | 11/1983 | Joshi | 252/135 |
| 4,427,417 | 1/1984 | Porasik | 252/99 |
| 4,661,333 | 4/1987 | Atkinson et al. | 423/328 |
| 4,761,248 | 8/1988 | Clift | 252/527 |
| 4,783,281 | 11/1988 | Bishop et al. | 252/135 |
| 4,992,079 | 2/1991 | Lutz | 252/174 |
| 5,338,528 | 8/1994 | Sörensson et al. | 423/333 |
| 5,427,711 | 6/1995 | Sakaguchi et al. | 510/376 |
| 5,468,516 | 11/1995 | Yamashita et al. | 510/441 |
| 5,529,715 | 6/1996 | Kuroda et al. | 252/135 |

FOREIGN PATENT DOCUMENTS

| | | |
|---|---|---|
| 0097512 | 1/1984 | European Pat. Off. . |
| 0150613 | 8/1985 | European Pat. Off. . |
| 0319053 | 6/1989 | European Pat. Off. . |
| 0353562 | 2/1990 | European Pat. Off. . |
| 0450989 | 10/1991 | European Pat. Off. . |
| 2143093 | 2/1973 | France . |
| 2183132 | 12/1973 | France . |
| 1297587 | 8/1963 | Germany . |
| 2322123 | 11/1973 | Germany . |
| 2239102 | 2/1974 | Germany . |
| 2604457 | 8/1976 | Germany . |
| 738375 | 10/1955 | United Kingdom . |
| 1029263 | 5/1966 | United Kingdom . |
| 1333810 | 10/1973 | United Kingdom . |
| 1473201 | 5/1977 | United Kingdom . |
| 1473202 | 5/1977 | United Kingdom . |
| 2013707 | 2/1978 | United Kingdom . |
| 9117232 | 11/1991 | WIPO . |

OTHER PUBLICATIONS

Database WPIL, Section Ch, Derwent Publications Ltd., London, GB; Class D25, An 84-259618 & JP-59 157 198 (Lion Corp.) 6 Sep. 1984.

*Primary Examiner*—Ardith Hertzog

*Attorney, Agent, or Firm*—Burns, Doane, Swecker & Mathis, L.L.P.

[57] ABSTRACT

Unique detergent compositions include a calcium precipitate-scavenging amount of an amorphous alkali metal silicoaluminate, advantageously are devoid of phosphate and zeolite values, and typically comprise at least one amorphous alkali metal silicoaluminate, an alkali metal carbonate, and at least one inhibitor of the crystal growth of calcium carbonate, such alkali metal carbonate being present in ionic calcium-removing amounts.

4 Claims, No Drawings

METHOD OF WASHING WITH DETERGENT COMPOSITIONS COMPRISING AMORPHOUS SILICOALUMINATE SCAVENGERS OF CALCIUM PRECIPITATES

This application is a continuation of application Ser. No. 08/405,932, filed Mar. 17, 1995 now abandoned, which is a continuation, of application Ser. No. 08/067,011, filed on May 26, 1993, now abandoned.

BACKGROUND OF THE INVENTION

1. Field of the Invention

The present invention relates to novel detergent compositions comprising amorphous alkali metal silicoaluminates as scavengers for calcium precipitates.

The present invention also relates to detergent compositions comprising at least one amorphous alkali metal silicoaluminate, alkali metal carbonate and at least one inhibitor of the crystal growth of calcium carbonate, the alkali metal carbonate serving as the principal agent for removing ionic calcium. Such detergent compositions are especially useful in detergent powders for washing machine or for dishwasher applications.

2. Description of the Prior Art

It is known to this art that a detergent composition must elicit a so-called "softening" effect on the water employed for washing. It must therefore remove the calcium and magnesium which are present in the wash water in the form of soluble salts and in the soiling of linen in more or less soluble complex forms. The removal of the calcium and of the magnesium can be carried out either by complexing in the form of soluble species, or by ion exchange, or by precipitation. When precipitation occurs, it must be controlled to avoid deposits on the linen or on the dishes, or in the washing machines.

It too is known to this art that such control of precipitation can be attained, in particular, by using water-soluble polymers which have an affinity for calcium and magnesium. However, this control of precipitation can prove to be insufficient and therefore unsatisfactory, this disadvantage being encountered more particularly in the event that the detergent composition includes sodium carbonate as an agent for removing the calcium.

SUMMARY OF THE INVENTION

Accordingly, a major object of the present invention is the provision of novel detergent compositions which avoid or conspicuously ameliorate the above disadvantages and drawbacks to date characterizing the state of this art.

Another object of this invention is the provision of novel detergent compositions, the principal calcium scavenger of which being neither a phosphate nor a zeolite.

Briefly, the present invention features novel detergent compositions comprising a calcium precipitate-scavenging amount of an amorphous alkali metal silicoaluminate.

By "calcium precipitates" are intended those calcium precipitates which are produced by precipitation of calcium with an agent present in the detergent composition. More particularly, the calcium precipitates are produced by precipitation of calcium with the alkali metal carbonate, preferably sodium carbonate, which is present in the detergent composition. However, such calcium precipitates can also be produced when the detergent composition contains a small amount of phosphates, such as sodium tripolyphosphate, which, under these conditions, sequester the calcium in an insoluble form.

DETAILED DESCRIPTION OF PREFERRED EMBODIMENTS OF THE INVENTION

More particularly according to the present invention, the amorphous alkali metal silicoaluminates employed as scavengers for calcium precipitates are compounds per se well known to this art and which can be prepared via the general process which entails mixing, preferably with stirring, a solution of an alkali metal silicate and a solution of an alkali metal aluminate or of aluminum sulfate. Alkali metal hydroxide may optionally be added. This mixture gels or precipitates; it is then filtered, washed and then dried by any means known per se.

The amorphous alkali metal silicoaluminate preferably employed in the present invention has the general formula (1): $xM_2O \cdot yAl_2O_3 \cdot zSiO_2 \cdot wH_2O$, in which formula M is an alkali metal, preferably sodium, x ranges from 0.2 to 2, y is equal to 1, z ranges from 0.2 to 15 and w is a real positive number other than 0. More particularly, the amorphous silicoaluminate has the formula (1) in which x ranges from 0.8 to 1.2, z ranges from 8 to 15 and w ranges from 0.3 to 9.

It is preferable that the amorphous silicoaluminate employed according to the invention should have a calcium exchange capacity greater than or equal to 50 mg of $CaCO_3$/g of anhydrous silicoaluminate and/or an absorbency greater than 100 ml/100 g, preferably greater than 150 ml/100 g ("DOP" uptake, ISO Standard 787/5).

Tixolex 25 and 28®, which are manufactured and marketed by Rhône-Poulenc, thus are exemplary.

The present invention also features detergent compositions comprising at least one amorphous alkali metal silicoaluminate, alkali metal carbonate (the alkali metal preferably being sodium) and at least one inhibitor of the crystal growth of calcium carbonate, the alkali metal carbonate being present, especially, as the principal agent for removing ionic calcium.

The amorphous alkali metal silicoaluminates incorporated into the detergent compositions according to the invention are those described above and preferably exhibit the characteristics and properties indicated above.

The alkali metal carbonate is present in the detergent compositions according to the invention, especially, as the principal agent for removing ionic calcium. Thus, in a preferred embodiment of the invention, the minimum amount of alkali metal carbonate present in the detergent compositions corresponds to the amount required to precipitate the ionic calcium. More particularly, the detergent composition is devoid of phosphate and devoid of zeolite.

Of course, in another embodiment of the invention, the subject compositions may include other agents for removing ionic calcium, such as, especially, phosphates, more particularly sodium tripolyphosphates, or zeolites. In these detergent compositions, the alkali metal carbonate removes more than half of the calcium present; the minimum total amount of these agents which are present in the detergent compositions is then that required to remove the ionic calcium.

The alkali metal carbonate may also provide alkalinity in certain detergent compositions. In these compositions, the amount of alkali metal carbonate then corresponds to the amount required to precipitate the ionic calcium and to provide the desired pH to the washing bath. This pH is generally higher than 9, preferably higher than 10. The alkali metal carbonates employed may be those of common grades.

By "washing bath" is intended the aqueous solution of washing aid (detergent composition) present in the washing machine during the wash cycles.

By "inhibitors of the crystal growth of calcium carbonate" are intended those products which therefore make it possible to arrest the crystal growth of the calcium carbonate nuclei without, however, preventing their nucleation. Indeed, without wishing to be bound by or to any scientific theory whatever, the presence of these inhibitors is reflected in the rapid disappearance of ionic calcium, without visible precipitation when alkali metal carbonate is added to hard water. These inhibitors are typically water-soluble polymers, which may be biodegradable. However, citric, tartaric and phosphonic acids (such as Dequest® marketed by Monsanto) and their salts are also suitable. Exemplary such inhibiting polymers include, in particular, polyacrylic acids, preferably having molecular weights ranging from 2,000 to 10,000, and salts thereof, acrylic-maleic or -vinyl copolymer acids preferably having molecular weights ranging from 50,000 to 70,000, and salts thereof, polyaspartic acids and salts thereof, and the polyimide biopolymers described in published French Patent Application No. 91/04,566, filed Apr. 15, 1991 and assigned to the assignee hereof. These biopolymers have a $COO^-$ charge density ranging from 0 to $5\times10^{-4}$ mol/g of polymer and are capable of acquiring a $COO^-$ charge density of at least $10^{-3}$ mol/g of polymer by hydrolysis in the washing bath. These inhibitors can be employed by themselves or as a mixture.

In the following description, as well as the description given above, all reported percentages are percentages by weight, unless otherwise indicated.

The washing compositions according to the invention preferably comprise from 2% to 10% of amorphous alkali metal silicoaluminate, from 10% to 30% of alkali metal carbonate and from 3% to 15% of inhibitors of the crystal growth of calcium carbonate; the percentages are given relative to the total weight of said composition. More particularly, the washing compositions according to the invention comprise from 2% to 10% of amorphous alkali metal silicoaluminate, from 15% to 25% of alkali metal carbonate and from 3% to 6% of inhibitors of the crystal growth of calcium carbonate.

The detergent compositions may be formulated by any known means. These especially may be prepared via the conventional technique, which entails introducing the constituents into an aqueous suspension (slurry), this solution then being spray-dried.

The detergent compositions according to the invention advantageously comprise alkali metal silicate, preferably sodium silicate. This silicate may be introduced into the aqueous solution containing the other constituents of the washing aid in order to subsequently be sprayed together and may be present in an amount of about 0.6% to about 19%.

In another preferred embodiment of the invention, the alkali metal carbonate and the alkali metal silicate are in the form of cogranulates. Thus, the washing aid composition comprises the amorphous alkali metal silicoaluminate, the inhibitor of the crystal growth of calcium carbonate and spherical cogranulates based on alkali metal silicate hydrate and alkali metal carbonate. These cogranulates are described in French Patent Application No. 92/03,350, filed Mar. 20, 1992 and assigned to the assignee hereof, and in European Patent Application No. 0,488,868, filed Nov. 25, 1991 and also assigned to the assignee hereof. In particular, these cogranulates are characterized by the process for their preparation, which comprises (a) spraying an aqueous solution based on alkali metal silicate or based on a mixture of alkali metal silicate and carbonate onto a rolling bed of particles based on alkali metal carbonate or based on the aforesaid identical silicate/carbonate mixture travelling in a rotary granulating device, the speed of travel of the particles, the thickness of the rolling bed and the flow rate of the sprayed solution being such that each particle is converted into a plastic cogranulate while coming into contact with other particles, (b) optionally drying said cogranulates obtained in (a), these steps (a) and (b) being carried out such that the weight ratio of water associated with the silicate/silicate expressed on a dry basis remains greater than or equal to 33/100, preferably 36/100.

Between the steps (a) and (b), the cogranulates are preferably subjected to a densifying operation.

By "water associated with the silicate" is intended the water in said aqueous solution which has not combined with the silicate, especially which is not in crystalline form.

In this embodiment of the invention, the cogranulates are added to the detergent compositions by post-addition.

The cogranulates are formulated into the detergent compositions according to the invention, for dishwasher applications, in a preparation of 3% to 90% by weight, preferably of 3% to 70% by weight, of such compositions. The quantities formulated into detergent compositions according to the invention for washing machine applications are on the order of 3% to 60%, preferably of 10% to 50%, of the weight of such compositions (these quantities are expressed as the weight of dry silicate relative to the weight of the composition).

Other than the constituents of the detergent compositions according to this invention, at least one surface-active agent may also be present, in a quantity which may range from 8% to 30%, preferably on the order of 10% to 15%, of the weight of the composition.

Exemplary of such surface-active agents are:

(i) anionic surface-active agents of the alkali metal soap type (alkali metal salts of $C_8$–$C_{24}$ fatty acids), alkali metal sulfonates ($C_{12}$–$C_{13}$ alkylbenzenesulfonates, $C_{12}$–$C_{16}$ alkylsulfonates), oxyethylenated and sulfonated $C_6$–$C_{16}$ fatty alcohols, oxyethylenated and sulfated C8–C13 alkylphenols, alkali metal sulfosuccinates ($C_{12}$–$C_{16}$ alkylsulfosuccinates), etc.;

(ii) nonionic surface-active agents of the polyoxyethylenated $C_6$–$C_{12}$ alkylphenol type, oxyethylenated $C_8$–$C_{22}$ aliphatic alcohols, ethylene oxide/propylene oxide block copolymers, and optionally polyoxyethylenated carboxylic amides;

(iii) amphoteric surface-active agents of the alkyldimethylbetaine type; and (iv) cationic surface-active agents of the alkyltrimethylammonium or alkyldimethylethylammonium chloride or bromide type.

Various other constituents may additionally be incorporated into the detergent compositions, such as:

(1) nitriloacetic acid, up to approximately 10% of the total formulation weight;

(2) bleaching agents of the perborate, percarbonate, chloroisocyanurate or N,N,N',N'-tetraacetylethylenediamine (TAED) type, up to approximately 30% of the total weight of said detergent composition;

(3) antiredeposition agents of the carboxymethyl cellulose or methyl cellulose type, in quantities which may range up to approximately 5% of the total weight of said detergent composition; and (4) fillers of the sodium sulfonate type for detergent powders, in a quantity which may range up to 50% of the total weight of said composition.

In order to further illustrate the present invention and the advantages thereof, the following specific examples are given, it being understood that same are intended only as illustrative and in nowise limitative.

COMPARATIVE EXAMPLE 1

Calcium Sequestration Kinetics

Free calcium was measured in a bath of 100 ml of water with the aid of an electrode specific for ionic calcium (Orion®).

The water had a Ca++ concentration of 3 moles/liter.

At t=0, 0.1 g of dry material interacting with the calcium in the water was introduced.

In this example, only sodium carbonate was introduced.

EXAMPLES 2 AND 3

The procedure of Comparative Example 1 was repeated; Tixolex 25® was added to the sodium carbonate in the following ratios by weight:

Tixolex 25®/carbonate equal to 75/25 (Example 2)

Tixolex 25®/carbonate equal to 25/75 (Example 3).

The results obtained are reported in Table I.

In this Table, the concentrations are expressed in moles per liter.

TABLE I

| EXAMPLES | $[Ca^{++}]_{t=0}$ | $[Ca^{++}]_{t=100\ ms}$ | $[Ca^{++}]_{t=300\ ms}$ |
|---|---|---|---|
| 1 | 3 | 0.25 | 0.1 |
| 2 | 3 | 1.5 | 0.8 |
| 3 | 3 | 0.1 | 0.05 |

EXAMPLES 4 AND 5

Two detergent formulations for washing machine applications were tested.

Synthesis of the Cogranulates

The granulation system was a flat dish 800 mm in diameter and 100 mm in depth. During the granulation, the speed of rotation was on the order of 25 rev/min and the inclination of the axis of rotation relative to the horizontal was on the order of 55°. The granulating dish was fed continuously at a rate of 21.4 kg/h with a powder of fine particles of sodium carbonate, the principal characteristics of which were the following:

(a) alkalinity assay: 99.61%, (b) water content (by weight)=0.12%, (c) untamped packing density=0.56 g/cm$^3$, (d) median diameter=95 microns, (e) insolubles content=58 mg/kg.

Onto this powder rotating in the granulating dish, a solution of sodium silicate was sprayed with the aid of air at 80° C. at a rate of 13.4 l/h at a temperature of 80° C. by means of a twin-fluid nozzle situated at a distance of 20 cm from the bottom of the pelletizer. The proportion of active substance and the $SiO_2/Na_2O$ molar ratio of the sprayed solution were 43% (by weight) and 2 respectively.

The mean residence time of a particle in the dish ranged from approximately 10 to 15 minutes. The temperature of the particles exiting the dish was the ambient temperature.

The granules exiting the dish were introduced into a smooth-walled rotating tube 500 mm in diameter, 1,300 mm in length and at an inclination on the order of 5%. The exit diaphragm was adjusted such that the mean residence time of a particle was approximately 40 min. The rate of rotation of the drum (18 rev/min) was selected such as to provide a rolling bed of particles, which promoted densification of the latter.

The granules thus obtained were dried in a fluidized bed at a temperature on the order of 80° C. (temperature of the fluidizing air equal to 85°-90° C.) for 10 to 15 min.

Thus dried, the product exhibited the following characteristics:

(a) carbonate content (by weight)=65%, (b) silicate content (by weight)=21% ±0.5%, (c) water content (by weight)=13.5%, (d) untamped packing density=0.90 g/cm$^3$, (e) % by weight oversize at 1 mm=10.8%, (f) median diameter=0.73 microns, (g) % by weight undersize at 0.2 mm=6%, (h) 90% (by weight) of the product dissolved in 50 s (aqueous solution at a concentration of 35 g/1 at 20° C.), (i) 95% (by weight) of the product dissolved in 65 s (aqueous solution at a concentration of 35 g/1 at 20° C., (j) whiteness L=96.3, (k) attrition resistance: 7%.

The granules exhibited excellent storage behavior and stability.

Preparation of the Detergent Formulations

The cogranulates synthesized were introduced into a Lodige M5G® mixer with additives in order to produce compositions for a dishwasher.

The compositions are set forth in Table II.

These compositions were tested in a Miele® household dishwasher, the water softener of which was not regenerated; as a result, it provided a limestone water with a total hardness of 30° TH (French scale).

10 cumulative washings of soda-lime glass plates, initially perfectly clean, were carried out using each composition, employed at 3 g/liter of water.

The plates were then subjected to a photometric measurement with the aid of a Gardner instrument.

The total amount of light L reflected by the sample was measured (Lab measurement system).

TABLE II

| EXAMPLES | 4 | 5 |
|---|---|---|
| Cogranulates | 54% | 49% |
| Tixolex 25 ® | 5% | 10% |
| Sodium citrate | 25% | 25% |
| Perborate monohydrate | 11% | 11% |
| TAED | 2% | 2% |
| Enzymes | 1% | 1% |
| Surfactants | 2% | 2% |
| L | 55 | 20 |

A composition without Tixolex was also tested (59% of cogranulates, remainder identical with the formulations of Examples 4 and 5); the L obtained was 63.

COMPARATIVE EXAMPLES 6, 7, 8 AND 9

Detergent formulations for a washing machine application were tested. Their compositions are set forth in Table III.

In the case where the detergent formulation comprised cogranulates, these cogranulates were those described in Examples 4 and 5 and were introduced by dry blending with the additives in order to obtain the compositions for a washing machine.

The sodium silicate reported in Table III had a $SiO_2/Na_2O$ molar ratio of 2 and a solids content of 80%.

Antideposition Performance Test

This test was carried out in a Schultess Super 6 De Luxe® drum machine.

The conditions of the trials were the following:

(1) cycle employed: 60° C., (2) total cycle time=65 minutes; no prewash, (3) number of cycles: 25 cumulative washes, (4) water hardness: 21.2 French degrees of hardness, (5) test fabric employed: control strip corresponding exactly to the specifications indicated in NFT Standard 73.600, (6) linen load: 3 kg of 100% cotton terry towelling, (7) washing aid measures: 5 g/1.

The test pieces which had been subjected to 25 washes were dried; they were weighed and calcined at 900° C.

The % by weight of ash was measured in relation to the weight of the initial test pieces (="deposits" in Table III).

EXAMPLE 10

The procedure of Comparative Examples 6, 7, 8 and 9 was repeated, but Tixolex 25 was added to the formulation of Comparative Example 9 (see composition in Table III).

The test results of these latter five examples are reported in Table III:

TABLE III

| EXAMPLE | 6 | 7 | 8 | 9 | 10 |
|---|---|---|---|---|---|
| ZEOLITE 4A | 25 | | | | |
| SODIUM SILICATE | 6 | | | | |
| SODIUM CARBONATE | 12 | | | | |
| COGRANULATES | | 45 | 45 | 40 | 40 |
| SOKALAN CPS | 5 | | 5 | 5 | 5 |
| SODIUM CITRATE | | | | 5 | 5 |
| TIXOLEX 25 | | | | | 5 |
| SODIUM SULFATE | 7 | 10 | 5 | 5 | |
| PERBORATE MONOHYDRATE | 15 | 15 | 15 | 15 | 15 |
| TAED | 5 | 5 | 5 | 5 | 5 |
| LAB ® (80%) | 10 | 10 | 10 | 10 | 10 |
| CEMULSOL ® (DB618, LA40, LA90) | 8 | 8 | 8 | 8 | 8 |
| MAGLEX 120 ® | 1.8 | 1.8 | 1.8 | 1.8 | 1.8 |
| ENZYMES | 0.3 | 0.3 | 0.3 | 0.3 | 0.3 |
| TINOPAL DMSX and SOP ® | 0.4 | 0.4 | 0.4 | 0.4 | 0.4 |
| POWDERED SILICONES | 2.5 | 2.5 | 2.5 | 2.5 | 2.5 |
| CARBOXYMETHYL CELLULOSE | 2 | 2 | 2 | 2 | 2 |
| DEPOSITS | 1.56 | 6.03 | 3.66 | 3.22 | 1.8 |

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed:

1. A method of washing fabrics in a washing machine or dishes in a dishwasher wherein said fabrics or said dishes are contacted with a phosphate free detergent powder, said detergent powder comprising as a precipitate scavenging agent a mixture comprising:

an amorphous alkali metal silicoaluminate having the general formula:

$xM_2O \cdot yAl_2O_3 \cdot zSiO_2 \cdot wH_2O$, in which M is an alkali metal, x is a number ranging from 0.2 to 2, y is equal to 1, z is a number ranging from 8 to 15, and w is a real positive number other than 0, the mixture further comprising an alkali metal carbonate and an alkali metal silicate, wherein the quantity of amorphous alkali metal silicoaluminate represents from 2 to 10% of the weight of the powder, the metal silicate represents about 21% of the powder, and the quantity of the alkali metal carbonate corresponds at least to that necessary to precipitate ionic calcium.

2. A method of washing with the phosphate free detergent powder as defined in claim 1 wherein said alkali metal silicate and at least a part of the alkali metal carbonate are present as spherical cogranulates.

3. A method of washing with the phosphate free detergent powder as defined in claim 2 wherein the spherical cogranulates include a weight ratio of water not in crystalline form and associated with the silicate/silicate expressed on a dry weight basis greater than 33/100.

4. A method of washing fabrics in a washing machine or dishes in a dishwasher wherein said fabrics or said dishes are contacted with a phosphate free detergent powder, the detergent powder comprising a mixture of amorphous alkali metal silicoaluminate having a $SiO_2/Al_2O_3$ ratio of at least 8:1 and wherein said alkali metal silicoaluminate makes up about 2% to about 10% by weight of said powder; an alkali metal carbonate, the alkali metal carbonate being present as a scavenging agent in an amount effective for precipitating ionic calcium and wherein said amount is at least 10% by weight of the detergent powder; at least one inhibitor of the crystal growth of calcium carbonate; and an alkali metal silicate in an amount of about 21%.

* * * * *